United States Patent [19]

Vetter

[11] 3,979,877

[45] Sept. 14, 1976

[54] VACUUM PACKAGING MACHINE WITH WEB REGISTRATION MEANS

[75] Inventor: Arthur Vetter, Gronenbach, Germany

[73] Assignee: Multivac Sepp Haggenmueller KG, Wolfertschwenden, Germany

[22] Filed: July 25, 1975

[21] Appl. No.: 598,977

[30] Foreign Application Priority Data

Aug. 1, 1974 Germany ..... 7426250[U]

[52] U.S. Cl. ..... 53/51

[51] Int. Cl.[2] ..... B65B 41/18; B65B 57/04

[58] Field of Search ..... 53/51, 112 A, 184 R

[56] References Cited

UNITED STATES PATENTS 3,397,508 8/1968 Stroop ..... 53/184

*Primary Examiner*—Robert L. Spruill

*Attorney, Agent, or Firm*—W. G. Fasse; W. W. Roberts

[57] ABSTRACT

A vacuum packaging machine is disclosed for the production of packages from two different packaging material webs, one having printing marks on it. By controlling the movement of the individual working stations in accordance with the spacing of the printing marks the correct position of the imprinted cover foils on the formed trays is achieved.

18 Claims, 3 Drawing Figures

VACUUM PACKAGING MACHINE WITH WEB REGISTRATION MEANS

BACKGROUND OF THE INVENTION

The invention relates to a vacuum packaging machine for the production of sealed packages from a first packaging material web having printed marks thereon and a second packaging material web. The machine has at least one deep drawing station which is movable in the longitudinal direction. The deep drawing station includes an upper processing unit and a lower processing unit adapted to perform a reciprocating movement with respect to each other, whereby the first web is fed responsive to printing marks relative to the forms fabricated out of the second web in the deep drawing station.

Material webs suitable for packaging are, as a rule, light flexible materials. The adherence to precise tolerance limits of printing marks is possible only with great technical effort. With typical commonly available packing material webs a tolerance range of ± 1% is observed. Known prior art packaging machines work acceptably when, at best, a tolerance of 0.6% occurs. If the spacing of the printing marks is too small the packaging material web is stretched. If, on the other hand, the spacing of the successive printing marks is greater than necessary, the entire printing mark control fails, because the sealing already results as soon as the next performed form is deposited in the sealing station and independent of the next printing mark. The printing marks appear continuously delayed in the course of sequential sealing and there occurs no more adjustment whatever to the marks.

OBJECT OF THE INVENTION

It is a primary object of the invention to provide a vacuum packaging machine in which imprinted cover-foils are correctly sealed to the trays.

It is a further object of the present invention to improve the prior art vacuum packing machine so that with a departure of the position of the printing marks a correction of the individual work stations of the vacuum packaging machine is possible.

It is a further object of the invention to provide a vacuum packaging machine wherein the sealed packages are separated in the correct position between the trays.

SUMMARY OF THE INVENTION

In this purpose, the present invention distinguishes over prior art vacuum packaging machines in that with the departure of the printing mark spacing from a desired value, the deep drawing apparatus is so movable that the spacing of a pair of consecutive forms is correspondingly changed.

In accordance with a preferred exemplary form the spacing change results through longitudinal displacement of the deep drawing apparatus.

In accordance with a preferred exemplary embodiment a detector responsive to the printed mark is provided, the output signal of which controls the longitudinal displacement.

By a preferred embodiment of the invention a second detector is provided by means of which a correction device is so controlled that the sealing station and the separating station present a predetermined spacing to the deep drawing station.

Further features and advantages of the invention are apparent from the description of the preferred embodiment taken in connection with the Figures.

BRIEF FIGURE DESCRIPTION

DETAILED DESCRIPTION OF EXAMPLE EMBODIMENT

Figure 1:
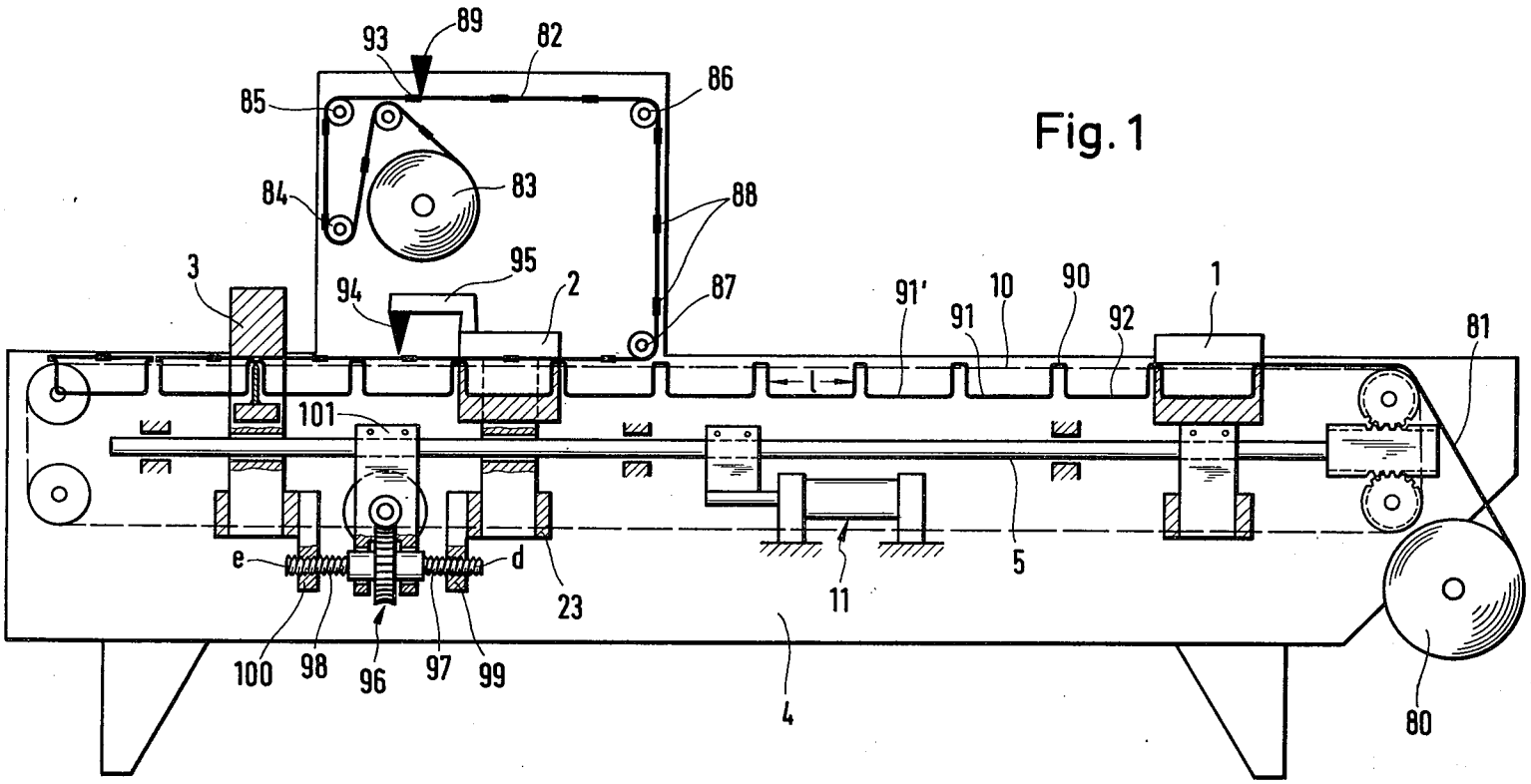
FIG. 1 is a longitudinal view through an embodiment of the vacuum packaging machine whereby the work stations are schematically shown.

The principle embodiment of the vacuum packaging machine is disclosed in FIG. 1. Three work stations, namely a deep drawing station 1, a vacuum and sealing station 2, and a separating station 3 are carried by a frame 4. A lower foil web 81 is drawn off a first roll 80, grasped by the chain gripping device 10, 10' shown in FIG. 3, and advanced through the individual stations. The bottom half of the package is drawn in deep drawing station 1 and is moved to the sealing station 2. An upper foil web 82 is drawn off a second roll 83 by means of a suitable mechanism with guide rollers 84, 85, 86, 87 and over the forms below is likewise led through the sealing station.

The packages sealed in sealing station 2 are then separated from one another in separating station 3 through a suitable knife or cutting tool and, in the disclosed embodiment, discharged at the left.

Figure 2:
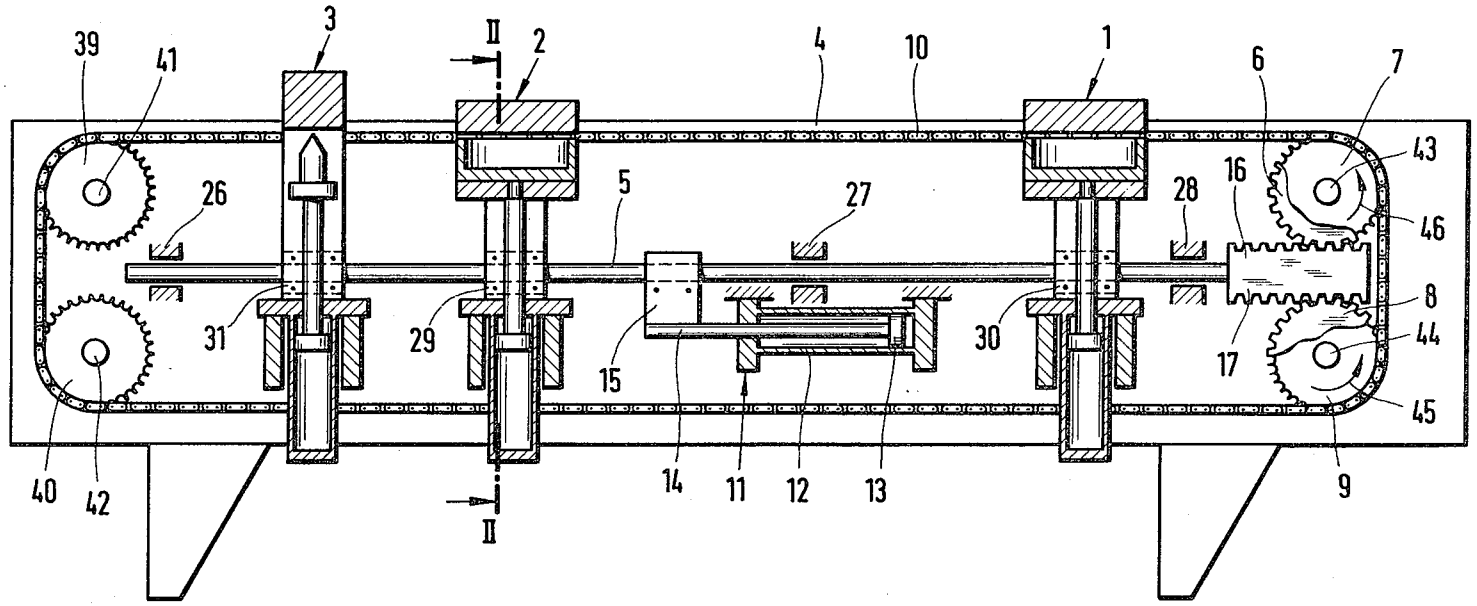
FIG. 2 is a longitudinal view similar to that shown in FIG. 1 whereby the work stations and associated movement devices are shown.
Figure 3:
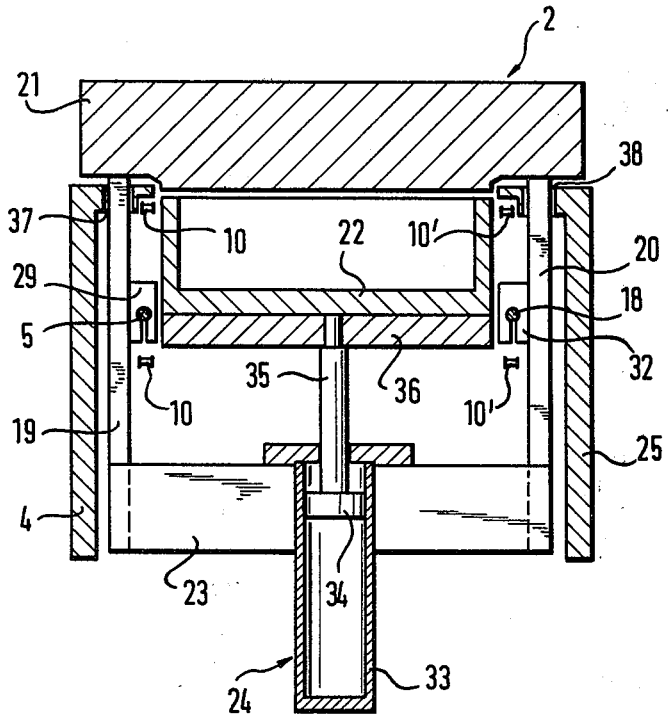
FIG. 3 is a cross sectional view through the apparatus shown in FIG. 2 taken along the line II—II.

In furtherance of the description, a particular embodiment of the work stations and the associated moving mechanism is initially described, with the aid of FIGS. 2 and 3, along with the therewith connected feed arrangement for the lower packaging material web.

The embodiment of the vacuum packaging machine shown in FIG. 2 exhibits machine frame 4, 25, with side frame 25 omitted to facilitate the illustration. Rods 5, 18, are coupled with machine frame 4, 25, for reciprocation with respect thereto by journals 26, 27, 28. The rods 5, 18, are reciprocated relative to the frame by means of a feed cylinder arrangement 11 formed of a cylinder 12, a piston 13, a piston rod 14, and a connecting link 15 connected to the rods.

The rods carry work stations 1, 2, 3. The work stations are in the disclosed exemplary embodiment connected with the rods by means of clamps 29, 30, 31, 32, in the manner best seen in FIGS. 2 and 3.

The three work stations shown in the exemplary embodiment in FIG. 2 are deep drawing station 1, vacuum station 2, and separating station 3. The construction of a work station in accordance with the inventive embodiment is best shown in FIG. 3, in which the vacuum station 2 is schematically illustrated in section. The work station includes an upper processing unit 21 and a lower processing unit 22. The upper processing unit 21 forms a strong frame with two side walls 19, 20 and a cross bar 23. On the side walls 19, 20 clamps 29, 32 are fastened on the inside of the frame at the level of rods 5, 18. The clamps are, in turn, connected by means of a clamp connection with the rods 5, 18, whereby the frames are carried by the rods and with the reciprocation of the rods are reciprocated relative to machine frame 4, 25.

The lower processing unit 22 is provided beneath the upper processing unit 21. The lower processing unit 22 is reciprocated relative to the upper processing unit by means of a piston-cylinder arrangement 24 formed of cylinder 33, piston 34, piston rod 35, and a lifting plate 36. The upper processing unit 21 and the lower processing unit 22 form a vacuum chamber. The chamber is connected in the usual manner with a vacuum pump by a not disclosed connecting pipe. The piston-cylinder arrangement 24 is connected with a not disclosed pressure medium input.

The vacuum station is opened and closed through the operation of piston-cylinder arrangement 24. The lifting and closing force operates only on the frame formed of the side parts 19, 20, the upper processing unit 21, and the cross bar 23, not on the machine frame. The stability of the machine is, thereby, substantially increased.

In the following, the connection between rods 5, 18, and the feed apparatus 10 is described by means of FIG. 3. The feed apparatus comprises, in the exemplary embodiment, a pair of chains 10, 10' (FIG. 3). The chain 10 shown in FIG. 3 is led about free wheeling feed sprockets 39, 40 and about sprockets 7, 9 in a closed track. The sprockets are mounted on axles 41, 42, 43, 44, respectively which are journalled in the machine frame.

Rod 5 contains upper and lower toothed rack 16, 17 in the end adjacent sprockets 7, 9. In the exemplary embodiment, the two toothed racks are formed as a single unitary double toothed rack. The toothed racks engage first and second gear wheels 6, 8 behind sprockets 7, 9, shown partially broken away, in FIG. 2. The first underlying gear wheel 8 is connected with sprocket 9 by means of an over running coupling so that with a movement of rod 5 to the left, the sprocket 9 is driven in the direction indicated by the arrow 45 and with a movement of the rod 5 in the opposite direction the sprocket is not driven. The upper, second gear wheel 6 is connected with sprocket 7 with an over running coupling so that the sprocket is driven in the direction of the arrow 46 with the movement of rod 5 and rack 16 to the right. Sprocket 7 is not driven with the movement of the rod 5 to the left. In this manner chain 10 is continuously driven through the linear reciprocation of rod 5 produced by the piston-cylinder apparatus 11.

The sprockets 7, 9, have a tooth spacing which corresponds to the link spacing of the applicable chain.

The mechanism described in connection with FIG. 2 for the rod 5 and chain 10 is similarly provided for the rod 18 and the chain 10'. It will be appreciated that the feed cylinder 11 is connected by an appropriate, not disclosed, conductor with a source of pressure. It will be further apparent that the work stations 1 and 3 contain in principle a similar construction to the work station shown in FIG. 3. Work stations 1 and 3 similarly comprise an upper processing unit which forms a frame with the side walls and a cross member, and a lower processing station which is reciprocated relative to the upper work station by means of a piston-cylinder arrangement connected to the cross member. The piston-cylinder unit is in each case connected with a pressure medium feed.

The machine works in the following manner. The packaging material web moves, in the embodiment shown in FIG. 2, from the right and with the advance of lead chain 10, 10' on both sides and in continuous movement is driven to the left by the reciprocating movement of rods 5, 18. In the first work stroke, rods 5, 18, are returned to the right. At the same time, the lower processing units are lowered downward into the open position. In the extreme right hand position of rods 5, 18, the lower processing units move upward through the piston-cylinder arrangements and the processing units close. The processing units 1, 2, 3 in the closed position move simultaneously with the material being driven by chain 10, 10' from right to left. During this movement phase the receptacle is deep drawn at station 1. The actual vacuum packaging (production of the vacuum, sealing of the edges of the packaging out of the upper and lower webs) occurs at station 2 and the separation of the side by side arranged packages occurs at station 3. At the left hand end of the movement path of rods 5, 18, shown in FIG. 2, the processing units are opened through lowering of the lower unit. Therefore the work stations can freely move relative to the material webs. Through the coordinated return movement of rods 5, 18, to the right, the work stations are returned to the initial position and the work operation can begin anew. The length of the movement path of rods 5, 18 is so selected that from the release of the material web in the work station at the left dead center position of the movement path of the rods to the right dead center position of the movement path of the rods, the material web is just sufficiently moved that the work stations in each case engage not previously worked material. The length of the reciprocal movement path of the rods can be adjusted through control of the pressure medium input to the feed arrangement 11. The feed length of the material web is in each case equal to the length of two strokes of the work cycle. In a practical embodiment the feed arrangement 11 is positioned in the middle between both rods 5, 18 so that it is connected by connection element 15 with both rods 5, 18 and so that the rods are simultaneously moved.

The spacing of work stations 1, 2, 3 to each other can be varied as by loosening the clamps 29, 32 and shifting the frames formed of the upper processing unit, the side walls, and the cross member relative to the rods. Also by the displacement of the work stations in this manner the processing units remain arranged concentric to the processing unit carrier formed of side walls 19, 20 and cross member 23. The stability of the work stations is thereby enhanced. Through the displacement of the work stations with respect to one another it is possible to accommodate the spacing of the processing unit stations at a well defined position in each case.

As is shown in FIG. 1, the upper packaging material web 82 contains printing marks 88. The printing marks are detected by a first detector 89 which, for example, may comprise a photocell. The detector provides an output signal to a not disclosed control circuit through which the length of the linear return movement of rods 5, 18, is determined in the disclosed exemplary embodiment by means of feed-cylinder apparatus 11. Through alteration of the right hand extreme position of rods 5 and 18, and, therewith, the deep drawing station 1, the width of the flanges 90 between two successive deep drawn forms 91 and 92 is varied. The length of each individual lower form 91, 92 is equal to the length *l* of the actual cup-formed section 1 plus two half flange widths. The detector 89 is so arranged that it detects the printing mark 93 on the covering foil section which belongs to the formed lower form just in the machine cycle. In the disclosed exemplary embodiment that means that the detector 89 detects the seventh printing mark before the sealing station 2, while in the deep drawing station exactly the seventh lower form from the sealing station 2 is formed.

As soon as the detector 89 ascertains that the spacing of the successive printing mark is smaller than the desired value, a signal is produced by means of the control through which the feed apparatus 11, the rods 5, 18, and therewith processing unit 1 returns to the right in the initial position less than by the normal spacing of the printing mark. In this manner, the width of the following flanges is reduced. If the detector 89 ascertains that the spacing of the successive printing mark is greater than the desired value, then feed cylinder 11, the rods 5 and 18, and the connected processing unit 1, is affected through the control and returned past the normal position to the right so that the flange between the next fabricated lower forms and the following fabricated lower forms is greater than normal. In this manner the continuous deviation of the spacing of successive printing marks is compensated for.

The compensation can be effected both in the case of a deviation of the entire packaging material web from a nominal value as well as the case in which the spacing of successive printing marks of the packaging material web varies for different successive printing marks in a differing manner or with a constant tendency.

In a simple exemplary embodiment, the control can be so formed that the return movement of rods 5, 18 toward the most distant right hand position stops when the detector detects the next printing mark 93. Thereafter a new work cycle begins.

With the embodiment of the invention shown in FIG. 1, the work stations with the attendant drive mechanisms are connected differently than they are in the embodiment shown in FIGS. 2 and 3. In the embodiment of FIGS. 2 and 3, the sealing station 2 and the separating station 3 are adjustable relative to deep forming station. This is accomplished by journals between the rods and the sealing station and separating station and by a connection means to the rods through which the position of these stations is adjustable with respect to the rods. In this manner, it is possible to displace the two stations 2 and 3 with a deviation from the nominal value of the right hand end starting position of the deep drawing station 1. The resulting changed spacing (flange width) of successive forms is such that the sealing seam produced by the sealing station 2 is formed at the desired location by the changed width of flanges 90 and the cross cutting by the separating apparatus 3 betwen two successive packages occurs in the correct position on the flange.

FIG. 1 shows a follow up device 96 with a position drive motor and threaded spindles 97, 98 for the follow up of work stations 2 and 3. The position motor is connected by means of a clamp or bolt connection 101 with the rods 5, 18 and simultaneously by means of the engagement of threaded spindles 97, 98 with stationary elements 99, 100 is connected with the work stations 2, 3. The elements 99, 100 are connected with the respective cross member 23. In this manner the work stations move with the reciprocal movement of rods 5, 18, in the longitudinal direction by means of the journals.

In the disclosed exemplary form a second detector 94 is provided which likewise may be formed of a photocell. The second detector 94 is connected by means of a connection yoke with the sealing station 2 and possesses a constant spacing from this. The detector is so arranged that it can ascertain whether the laterally running sealing seam produced by sealing station 2 on the edges of each package lies in the correct position relative to the lower form or whether the sealing station 2 and therewith also the separating station 3 exists too far to the right or too far to the left as a result of the changed right hand starting position of the deep drawing station 1. The output signal of detector 94 is provided to a control circuit not shown, which controls the operation of the position motor. If the output signal of detector 94 indicates that a displacement of stations 2 and 3 is necessary, then the position motor, by means of the spindles 97, 98 moves the stations 2 and 3 during successive work cycles a predetermined step to the right or to the left, until the detector 94 indicates that the sealing seam is produced in the desired position. The corrective direction through the position motor is attained in each case during the return movement of rods 5, 18 and work stations 1, 2, 3 to the starting point.

The detector 94 is positioned at a spacing of a half package length from the sealing station 2. If the spacing of the separating station from the detector 94 is greater than a half package length, the pitch e of spindle 98 is selected greater than the pitch d of spindle 97 so as to compensate the trend of deviations of successive printing marks spacing. The pitch ratio is determined in accordance with the equation $$e = d\ (1 + a/b)$$

whereby a is the number of the packages between sealing station 2 and separating station 3 and b is the number of packages between deep drawing station 1 and sealing station 2.

A piston-cylinder arrangement can also be employed in lieu of the use of the spindles to shift the spacing of the work stations 2 and 3 relative to deep drawing station 1. The different follow up of the sealing station 2 and the separating station 3 in the above described way is then effected by means of an appropriate control of the pressure means feeding the respective cylinders.

While there have been illustrated and described several embodiments of the present invention it will be understood that various changes and modifications may occur to those skilled in the art. It is intended to cover all modifications and equivalents within the scope of the application and the appended claims.

What is claimed is:

1. A vacuum packaging machine for producing sealed packages from a first packaging material web having marks spacedly printed thereon and a second packaging material web to be sealed with said first packaging material web, said machine including:

first feed means for conveying said second packaging material web through said machine in a predetermined feed direction; at least one work station having an upper processing unit and a lower processing unit, said upper and lower processing units being adapted to perform a reciprocating movement with respect to each other for engaging and processing said second packaging material web; second feed means for applying said first packaging material web to the processed second material web; drive means, positive coupling means coupled between said drive means and work station for reciprocating said work station, means for continuously coupling said drive means to drive said first feed means, whereby said work station moves in the same direction as and in synchronism with the feeding of said second web during an operating phase during which said work station engages said second web, and whereby said work station moves in a direction opposite to the feed direction of the web during a return phase in which said work station is disengaged from the web; and control means coupled to said drive means for controlling the amount of movement of said work station in the return phase in accordance with the spacing of said printing marks on said first packaging material web.

2. The vacuum packaging machine according to claim 1, further defined in that said work station (1) is a deep drawing station for forming packaging molds in said second packaging material web and said machine additionally includes a sealing work station (2) for sealing the webs coupled to said drive means for movement in the operating and return phases.

3. The vacuum packaging machine according to claim 2, further defined as including a separating work station (3) for separating the sealed webs coupled to said drive means for movement in the operating and return phases.

4. The vacuum packaging machine according to claim 3, further defined in that said deep drawing work station (1), said sealing work station (2), and said separating work station (3) are commonly driven in the feed direction of the second packaging material web and in the opposite direction.

5. The vacuum packaging machine according to claim 3, further including a frame (4, 25) and wherein said positive coupling means comprises rod means (5, 18) reciprocally journalled in said frame, said rod means being connected to and carrying said work stations (1, 2, 3) for movement in the operating and return phases said continuous coupling means comprising means coupled to said first feed means for driving said first feed means by the reciprocation of said rod means.

6. The vacuum packaging machine according to claim 5 further including a feed cylinder means (11) coupled between said frame (4, 25) and said rod means (5, 18) for reciprocating the latter.

7. The vacuum packaging machine according to claim 3, further defined as including a second detector (94) positioned between said sealing work station (2) and said separating work station (3) for ascertaining the position of the seals produced by said sealing work station with respect to processed portions of the second material web.

8. The vacuum packaging machine according to claim 7, further defined as including a follow up control device (96) for altering the position of said sealing work station (2) and said separating work station (3) with respect to said deep drawing work station (1) and wherein said second detector provides an output signal to said follow up control device for providing a predetermined spacing between said work stations.

9. The vacuum packaging machine according to claim 7, wherein the second detector (94) is mounted on said sealing work station (2) for movement therewith in the longitudinal direction.

10. The vacuum packaging machine according to claim 7, further including means responsive to the detection of said printing marks by said second detector for altering the spacing of said sealing work station (2) and said separating work station (3) from said deep drawing work station (1).

11. The vacuum packaging machine according to claim 10, further including means for altering the spacing of said separating work station (3) from said sealing work station (2).

12. The vacuum packaging machine according to claim 10, further defined as including means for simultaneously altering the spacing of said separating work station and said sealing work station (2) from said deep drawing work station (1).

13. The vacuum packaging machine according to claim 12, wherein said altering means further includes threaded spindle means in threaded engagement with said sealing work station (2) and said separating work station (3) and means for rotating said spindle means.

14. The vacuum packaging machine according to claim 13, wherein said threaded spindle means contains two parts (97, 98) connected with each other and engaging one of said work stations, respectively.

15. The vacuum packaging machine according to claim 14, wherein said two parts (97, 98) of said threaded spindle means contain dissimilar pitches.

16. The vacuum packaging machine according to claim 1, wherein said control means includes a monitoring detector (89) for detecting the printing mark (88, 93).

17. The vacuum packaging machine according to claim 16, characterized in that said detector is positioned from the last package sealed by said sealing work station along said first material web by a number of application sections equal to the number of previously processed portions (91, 92) of said second material web.

18. The vacuum packaging machine according to claim 16, further defined in that said detector provides an output signal responsive to the spacing of the printing marks for operating said drive means to control the amount of movement of said work stations in the return phase in accordance with the output signal of said detector (89).

* * * * *